US011788768B2

(12) United States Patent
Krause et al.

(10) Patent No.: US 11,788,768 B2
(45) Date of Patent: Oct. 17, 2023

(54) DEVICES FOR SUPPORTING HVAC CONDENSING UNITS OUTDOORS IN HIGH VELOCITY WIND ZONES AND METHODS OF MANUFACTURE AND USE THEREOF

(71) Applicant: DiversiTech Corporation, Duluth, GA (US)

(72) Inventors: Matthew D. Krause, Johns Creek, GA (US); Franco F. Daino, Dacula, GA (US); Jonathan M. Sada, Lawrenceville, GA (US); Bryce M. Lowe, Atlanta, GA (US); Charles S. Stephens, Atlanta, GA (US); James A. Kitchen, Lawrenceville, GA (US)

(73) Assignee: DiversiTech Corporation, Duluth, GA (US)

( * ) Notice: Subject to any disclaimer, the term of this patent is extended or adjusted under 35 U.S.C. 154(b) by 244 days.

(21) Appl. No.: 17/181,561

(22) Filed: Feb. 22, 2021

(65) Prior Publication Data

US 2021/0348801 A1 Nov. 11, 2021

Related U.S. Application Data

(60) Provisional application No. 62/981,849, filed on Feb. 26, 2020.

(51) Int. Cl.
*F24F 13/32* (2006.01)
*F24F 1/60* (2011.01)

(52) U.S. Cl.
CPC ..... *F24F 13/32* (2013.01); *F24F 1/60* (2013.01)

(58) Field of Classification Search
CPC ..... F24F 13/32; F24F 1/60
See application file for complete search history.

(56) References Cited

U.S. PATENT DOCUMENTS 1,605,920 A 11/1926 Burlin
2,820,887 A 1/1958 McInnis
(Continued)

FOREIGN PATENT DOCUMENTS

CN 2169763 Y 6/1994
CN 101338586 A 1/2009
(Continued)

OTHER PUBLICATIONS

EPS Geofoam Blocks, Material Properties and Production Processes, Jackon AS, Norway, downloaded from internet Feb. 22, 2021, https://my.civil.utah.edu/~bartlett/Geofoam/3a%20-%20JACKON%20presentasjon%20EPS%202011%20Lillestrom%20-%20final%202011-03-28%20RWA.pdf (7 pages).
(Continued)

*Primary Examiner* — Anita M King
(74) *Attorney, Agent, or Firm* — Dentons US LLP

(57) ABSTRACT

A method comprises: causing a volume of a material in an uncured state to be input into a container; causing a plurality of spikes hosted via a lid to extend into the volume of the material in the uncured state within the container such that the lid closes the container and the lid faces the volume of the material; causing the volume of the material within the container to change from the uncured state to a cured state within the container while the lid is closed such that the volume of the material in the cured state within the container secures the lid to the container via the spikes; and causing an outdoor HVAC condenser unit to rest on the container such that the volume of the material in the cured state within the container extends between the outdoor HVAC condenser unit and the lid.

38 Claims, 8 Drawing Sheets

(56) References Cited

U.S. PATENT DOCUMENTS

| | | | | |
|---|---|---|---|---|
| 3,469,809 | A | 9/1969 | Reznick | |
| 3,713,620 | A | 1/1973 | Tkach | |
| 3,722,845 | A | 3/1973 | Unger | |
| 4,023,755 | A | 5/1977 | Alesi, Jr. | |
| 4,189,125 | A * | 2/1980 | Little | F16M 1/00 248/346.02 |
| 4,240,557 | A | 12/1980 | Dickens | |
| 4,505,449 | A | 3/1985 | Turner et al. | |
| 4,869,456 | A * | 9/1989 | Jacobs | F16M 5/00 248/346.02 |
| 4,946,725 | A | 8/1990 | Harlan | |
| 5,333,830 | A | 8/1994 | Millen | |
| 5,615,519 | A | 4/1997 | Abe et al. | |
| 5,704,172 | A | 1/1998 | Gougeon et al. | |
| 5,728,458 | A | 3/1998 | Sweeney | |
| 5,895,025 | A | 4/1999 | Alesi et al. | |
| 5,950,980 | A | 9/1999 | Folmar | |
| 5,961,093 | A | 10/1999 | Jones et al. | |
| 5,981,822 | A | 11/1999 | Addison | |
| 6,050,539 | A | 4/2000 | Millen | |
| 6,219,981 | B1 | 4/2001 | Bergelt | |
| 6,395,384 | B1 | 5/2002 | Adam | |
| 6,427,965 | B1 | 8/2002 | McCracken | |
| 6,518,499 | B1 | 2/2003 | Kessler | |
| 6,655,648 | B2 | 12/2003 | Harris | |
| 6,705,105 | B2 | 3/2004 | Wendt et al. | |
| D496,058 | S | 9/2004 | Sargent et al. | |
| 6,863,253 | B2 | 3/2005 | Valentz et al. | |
| 7,300,032 | B2 | 11/2007 | Williams et al. | |
| 7,334,421 | B1 | 2/2008 | Cantolino | |
| D581,553 | S | 11/2008 | Cooper | |
| D590,123 | S | 4/2009 | Hermans | |
| D590,124 | S | 4/2009 | Hermans | |
| D590,572 | S | 4/2009 | Hermans | |
| D590,573 | S | 4/2009 | Hermans | |
| D600,874 | S | 9/2009 | Hermans | |
| D600,875 | S | 9/2009 | Hermans | |
| D605,312 | S | 12/2009 | Cerasi | |
| D608,917 | S | 1/2010 | Ward et al. | |
| 7,661,240 | B2 | 2/2010 | Sargent | |
| 7,780,140 | B1 | 8/2010 | Ward et al. | |
| D627,535 | S | 11/2010 | Hermans | |
| D629,533 | S | 12/2010 | Ward et al. | |
| 7,891,635 | B2 | 2/2011 | Rowland | |
| D656,705 | S | 3/2012 | Fling | |
| 8,136,782 | B2 | 3/2012 | Rowland | |
| 8,152,129 | B2 * | 4/2012 | Hermans | F16M 5/00 248/678 |
| 8,220,768 | B1 | 7/2012 | Cantolino | |
| D672,065 | S | 12/2012 | Hoffman | |
| D674,984 | S | 1/2013 | Reyhan et al. | |
| D678,649 | S | 3/2013 | Tornel Leanos | |
| D679,065 | S | 3/2013 | Hershey et al. | |
| D680,139 | S | 4/2013 | Snyder et al. | |
| D680,140 | S | 4/2013 | Snyder et al. | |
| D680,236 | S | 4/2013 | Snyder et al. | |
| D680,564 | S | 4/2013 | Snyder et al. | |
| D681,083 | S | 4/2013 | Snyder et al. | |
| D681,084 | S | 4/2013 | Snyder et al. | |
| D687,473 | S | 8/2013 | Edwards et al. | |
| D700,368 | S | 2/2014 | Shen | |
| 8,740,505 | B1 | 6/2014 | Rowland | |
| D726,334 | S | 4/2015 | O'Callaghan et al. | |
| 9,016,653 | B1 * | 4/2015 | Cox, Jr. | B65D 19/0002 52/292 |
| 9,074,812 | B2 | 7/2015 | Rowland | |
| D767,850 | S | 9/2016 | Van de Mark | |
| D773,694 | S | 12/2016 | MacDonald et al. | |
| D774,271 | S | 12/2016 | Marti | |
| D810,322 | S | 2/2018 | MacDonald et al. | |
| D824,133 | S | 7/2018 | Hawley et al. | |
| 10,054,333 | B1 * | 8/2018 | Colvin | F24F 13/32 |
| D828,973 | S | 9/2018 | Herbeck et al. | |
| D829,931 | S | 10/2018 | Eliason et al. | |
| D829,932 | S | 10/2018 | Eliason et al. | |
| D838,429 | S | 1/2019 | Herbeck et al. | |
| D844,181 | S | 3/2019 | Lundell | |
| D844,855 | S | 4/2019 | Dueck et al. | |
| D849,968 | S | 5/2019 | Downey et al. | |
| D851,788 | S | 6/2019 | Downey et al. | |
| 2003/0183741 | A1 | 10/2003 | Milner | |
| 2005/0148920 | A1 | 7/2005 | Addison | |
| 2005/0247851 | A1 | 11/2005 | Kessler et al. | |
| 2006/0005338 | A1 | 1/2006 | Ashe et al. | |
| 2009/0031658 | A1 * | 2/2009 | Moller, Jr. | E01C 13/045 52/578 |
| 2010/0212807 | A1 | 8/2010 | Princell et al. | |
| 2010/0320360 | A1 | 12/2010 | McLeod | |
| 2011/0147558 | A1 | 6/2011 | Marquardt et al. | |
| 2013/0032688 | A1 | 2/2013 | Snyder et al. | |
| 2013/0248674 | A1 | 9/2013 | Johnson et al. | |
| 2019/0128562 | A1 | 5/2019 | Xu et al. | |

FOREIGN PATENT DOCUMENTS

| | | | |
|---|---|---|---|
| CN | 204419005 | U | 6/2015 |
| CN | 204493578 | U | 7/2015 |
| CN | 204829136 | U | 12/2015 |
| CN | 108951992 | A | 12/2018 |
| JP | H1054499 | A | 2/1998 |
| JP | 2009185913 | A | 8/2009 |
| JP | 5227127 | B2 | 7/2013 |

OTHER PUBLICATIONS

Fabricated Packaging Materials, How is EPS Manufactured?, downloaded from internet Feb. 22, 2021, http://www.fpmfoam.com/how-is-eps-manufactured.htm (5 pages).

Hamilton, How to make AC slabs https://www.gardenguides.com/how_8749976_make-ac-slabs.html, Sep. 2017 (2 pages).

HT Mesh Fence, Model HT-04, Concrete filled base temporary fence feet plastic base, https://www.alibaba.com/product-detail/Concrete-Filled-Base-Temporary-Fence-Feet_888618543.html, downloaded from internet Jul. 2019 (3 pages).

Insulfoam, Insulation Comparison, downloaded from internet Feb. 22, 2021, https://www.insulfoam.com/insulation-comparisons/ (5 pages).

* cited by examiner

DEVICES FOR SUPPORTING HVAC CONDENSING UNITS OUTDOORS IN HIGH VELOCITY WIND ZONES AND METHODS OF MANUFACTURE AND USE THEREOF

CROSS-REFERENCE TO RELATED PATENT APPLICATIONS

This patent application claims a benefit of U.S. Provisional Patent Application 62/981,849 filed 26 Feb. 2020; which is incorporated by reference herein in its entirety for all purposes.

BACKGROUND

An HVAC system may have a condenser unit positioned outdoors. The condenser unit can rest on a pad laying on a ground surface in order to keep the condenser unit raised above the ground surface for efficient operation and safety purposes.

In high velocity wind zones (e.g., Florida), there are various legal requirements (e.g., building code) that govern how the condenser unit can rest on the pad. For example, one of such requirements is that the condenser unit be raised a certain distance above the ground surface. Another of such requirements is that the condenser unit, when anchored to the pad, must be able to resist various overturn forces that are generated by high winds. Usually, this overturn resistance is achieved through weight. As such, the pad can be entirely constructed out of concrete, which is heavy. Alternatively, the pad can have a shell constructed out of concrete and a foam core positioned within the shell in order to make the pad less heavy for transit, since solid concrete may make the pad heavier than necessary to comply with the legal requirements that govern how the condenser unit can rest on the pad.

When the pad is constructed, one conventional solution involves having a concrete slab that is poured in place at an installation site. However, this approach is not desirable because building up the concrete slab is time consuming and laborious. Additionally, this approach is not desirable because concrete slab must adequately cure, which delays installation of the condenser unit. If the concrete slab is constructed offsite, then the concrete slab can crack in transit to the installation site. Further, even if the concrete slab has the foam core, then the concrete slab is cumbersome to handle due to size and weight.

SUMMARY

Generally, this disclosure discloses various devices for supporting HVAC condenser units outdoors in high velocity wind zones (or non high velocity wind zones) and methods of manufacture and use thereof. For example, such devices can include a pad that includes a shell (e.g., plastic) that is filled with concrete (or another suitable material). The concrete provides a sufficient weight for overturn resistance and a solid anchoring medium for fasteners. The shell can provide an aesthetic outer surface, while still providing support function even if the concrete cracks. For example, the shell can include a top portion (e.g., container) and a bottom portion (e.g., lid), where the top portion would get the concrete poured thereinto and the bottom portion would be inserted into the concrete, as uncured, while covering the top portion. Once the concrete cures, then the top portion and the bottom portion are held together via the concrete, as cured. The bottom portion can incorporate a plurality of forklift slots. When the top portion and the bottom portion include a plurality of corners, then the corners can have a plurality of through-holes that allow a plurality of ground augers or anchors for additional overturn resistance, if needed.

In an embodiment, a device comprises: a top side including a first inner surface; a wall hosted via the first inner surface such that the first inner surface and the wall form an inner space, wherein the wall includes a first side and a second side, wherein the first inner surface extends between the first side and the second side, wherein the first side includes a first slot dipping toward the first inner surface and a second slot dipping toward the first inner surface, wherein the second side includes a third slot dipping toward the first inner surface and a fourth slot dipping toward the first inner surface, wherein the first side opposes the second side such that the first slot opposes the third slot and the second slot opposes the fourth slot; a bottom side including a second inner surface and an outer surface, wherein the outer surface includes a first channel and a second channel, wherein the first channel and the second channel extend parallel to each other; and a plurality of spikes hosted via the second inner surface, wherein the spikes extend toward the first inner surface into the inner space as the second inner surface faces the first inner surface when the first channel is co-aligned with the first slot and the third slot and the second channel is co-aligned with the second slot and the fourth slot.

In an embodiment, a method comprises: causing a volume of a material in an uncured state to be input into a container; causing a plurality of spikes hosted via a lid to extend into the volume of the material in the uncured state within the container such that the lid closes the container and the lid faces the volume of the material; causing the volume of the material within the container to change from the uncured state to a cured state within the container while the lid is closed such that the volume of the material in the cured state within the container secures the lid to the container via the spikes; and causing an outdoor HVAC condenser unit to rest on the container such that the volume of the material in the cured state within the container extends between the outdoor HVAC condenser unit and the lid.

In an embodiment, a kit comprises: a first unit including a top side and a wall, wherein the top side includes a first inner surface, wherein the wall is hosted via the first inner surface such that the first inner surface and the wall form an inner space, wherein the wall includes a first side and a second side, wherein the first inner surface extends between the first side and the second side, wherein the first side includes a first slot dipping toward the first inner surface and a second slot dipping toward the first inner surface, wherein the second side includes a third slot dipping toward the first inner surface and a fourth slot dipping toward the first inner surface, wherein the first side opposes the second side such that the first slot opposes the third slot and the second slot opposes the fourth slot; a second unit including a bottom side and a plurality of spikes, wherein the bottom side includes a second inner surface and an outer surface, wherein the outer surface includes a first channel and a second channel, wherein the first channel and the second channel extend parallel to each other, wherein the spikes are hosted via the second inner surface, wherein the spikes extend toward the first inner surface into the inner space as the second inner surface faces the first inner surface when the first channel is co-aligned with the first slot and the third slot and the second channel is co-aligned with the second slot and the fourth slot, wherein the first unit is separate and distinct from the second unit; and a container containing the first unit and the second unit.

DETAILED DESCRIPTION

Figure 1:
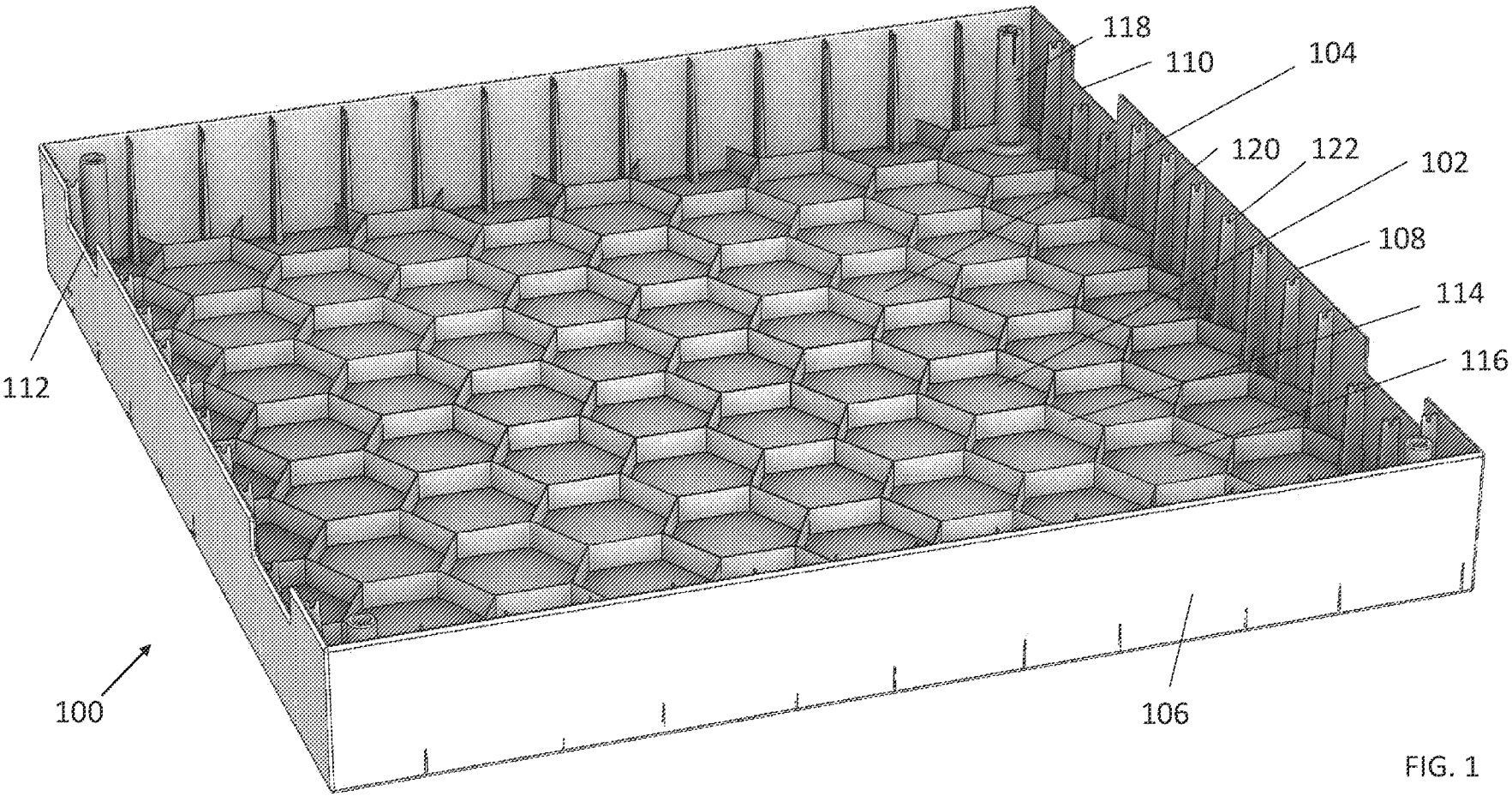
FIG. 1 shows an embodiment of a first unit according to this disclosure.

Generally, this disclosure discloses various devices for supporting HVAC condenser units outdoors in high velocity wind zones (or non high velocity wind zones) and methods of manufacture and use thereof. For example, such devices can include a pad that includes a shell (e.g., plastic) that is filled with concrete (or another suitable material). The concrete provides a sufficient weight for overturn resistance and a solid anchoring medium for fasteners. The shell can provide an aesthetic outer surface, while still providing support function even if the concrete cracks. For example, the shell can include a top portion (e.g., container) and a bottom portion (e.g., lid), where the top portion would get the concrete poured thereinto and the bottom portion would be inserted into the concrete, as uncured, while covering the top portion. Once the concrete cures, then the top portion and the bottom portion are held together via the concrete, as cured. The bottom portion can incorporate a plurality of forklift slots. When the top portion and the bottom portion include a plurality of corners, then the corners can have a plurality of through-holes that allow a plurality of ground augers or anchors for additional overturn resistance, if needed.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

FIG. 1 shows an embodiment of a first unit according to this disclosure. In particular, a first unit 100 is a container formed via a top side 102 and a wall 106.

The top side 102 includes an inner surface 104 (e.g., smooth, rough). The top side 102 including the inner surface 104 can include metal, metal alloy, plastic, polymer resin, or shape-memory alloy or resin.

The wall 106 is hosted (e.g., supported, extended, depended) via the inner surface 104 such that the inner surface 104 and the wall 106 form an inner space. However, note that the wall 106 can be hosted via the top side 102, but not via the inner surface 104 (e.g., outer surface, sidewall). The wall 106 can include metal, metal alloy, plastic, polymer resin, or shape-memory alloy or resin. The wall 106 is unitary (e.g., molded, cast, additively manufactured) with the top side 102 including the inner surface 104 such that the wall 106 and the top side 102 including the inner surface 104 include same material (e.g., plastic), but the wall 106 can be assembled with the top side 102 including the inner surface 104 (e.g., fastened, mated, interlocked, adhered, magnetized). The wall 106 is perpendicular to the inner surface 104 such that the inner space is volumetrically cuboid-shaped or cube-shaped. However, the wall 106 can be non-perpendicular (e.g., acutely or obtusely angled inward or outward) with the inner surface 104. For example, the wall 106 can be obtusely angled relative to the inner surface 104 such that the first unit 100 has a trapezoidal side profile. The wall 106 is rectilinear, but can be concave or convex, whether inward or outward. For example, the wall 106 can be outwardly convex such that the first unit 100 has a disc side profile. The wall 106 is a single wall 106, but can include a plurality of walls 106 forming the single wall 106, whether the walls 106 are or are not spaced apart from each other.

The wall 106 includes a plurality of sides 108 including a first side and a second side, where the inner surface 104 extends (e.g., spans) between the first side and the second side. The first side includes a first slot 110 dipping toward the inner surface 104 and a second slot 110 dipping toward the inner surface 104. The second side includes a third slot 112 dipping toward the inner surface 104 and a fourth slot 112 dipping toward the inner surface 104. The first side opposes the second side such that the first slot 110 opposes the third slot 112 and the second slot 110 opposes the fourth slot 112. Note that the sides 108 also include a plurality of sides that avoid the first slot 110, the second slot 110, the third slot 112, and the fourth slot 112, although all or no sides 108 can include or avoid the first slot 110, the second slot 110, the third slot 112, or the fourth slot 112. Further, note that although the wall 106 has four sides 108, other configurations are possible, where the wall 106 has less than four sides 108 (e.g., three) or more than four sides 108 (e.g., five, six). Therefore, in such configurations, the top portion 102 can appear triangular, pentagonal, hexagonal, or other polygonal or non-polygonal shape, whether an open shape or a closed shape, whether symmetrical or asymmetrical.

The inner surface 104 or the wall 106 host (e.g., support, extend, depend) a grid including a plurality of barriers 114 forming a plurality of cells 116. The barriers 114 can include metal, metal alloy, plastic, polymer resin, or shape-memory alloy or resin. The barriers 114 are solid, but can be perforated. The barriers 114 are perpendicular relative to the inner surface 104, although obtuse or acute angling is possible. The wall 106 encloses the grid inclusive of the barriers 114 and the cells 116. As such, the grid inclusive of the barriers 114 and the cells 116 extends (e.g., spans) between the sides 108, which can include the first slot 110, the second slot 112, the third slot 112, or the fourth slot 114. The cells 116 are adjacent to each other with the barriers 114 partitioning therebetween. The cells 116 are hexagonal or honeycomb shaped, but can be shaped differently (e.g., square, rectangle, triangle, pentagon). The barriers 114 are unitary (e.g., molded, cast, additively manufactured) with the inner surface 104 or the wall 106 such that the barriers 114 and the inner surface 104 or the wall 106 include same material (e.g., plastic), but can be assembled with the inner surface 104 or the wall 106 (e.g., fastened, mated, interlocked, adhered, magnetized).

The inner surface 104 or the wall 106 host (e.g., support, extend, depend) a plurality of tubular members 118 such that the wall 106 encloses the tubular members 118. The tubular members 118 are perpendicular relative to the inner surface 104, although non-perpendicular angling is possible (e.g., obtuse or acute). The tubular members 118 are longitudinally rectilinear, but can be non-rectilinear, (e.g., arcuate, sinusoidal). The tubular member 118 have sidewalls that are solid, but can be perforated. The tubular members 118 can include metal, metal alloy, plastic, polymer resin, or shape-memory alloy or resin. The tubular members 118 are unitary (e.g., molded, cast, additively manufactured) with the inner surface 104 or the wall 106 such that the tubular members 118 include same material (e.g., plastic), but can be assembled with the inner surface 104 or the wall 106 (e.g., fastened, mated, interlocked, adhered).

The inner surface 104 or the wall 106 host (e.g., support, extend, depend) a plurality of columns 120 along the wall 106 and contacting the wall 106, although non-contact is possible. For example, the columns 120 can extend from the inner surface 104 or the wall 106 or be exposed to the inner space or extend from the wall 106 toward the inner space. The wall 106 encloses the columns 120. The columns 120 can be uniform or varying in height. For example, the columns 120 include a first column and a second column, where the first column extends between the inner surface 104 and a slot selected from a group consisting of the first slot 110, the second slot 110, the third slot 112, and the fourth slot 112. The second column does not extend between the inner surface 104 and the slot selected from the group consisting of the first slot 110, the second slot 110, the third slot 112, and the fourth slot 112. The first column has a first height and the second column has a second height, where the first height is less than the second height, as shown for the first column extending underneath the slot selected from the group consisting of the first slot 110, the second slot 110, the third slot 112, and the fourth slot 112 and the second column not extending underneath the slot selected from the group consisting of the first slot 110, the second slot 110, the third slot 112, and the fourth slot 112.

The columns 120 are longitudinally rectilinear yet non-perpendicularly inclined (e.g., acutely or obtusely angled), but can be non-rectilinear, (e.g., arcuate, sinusoidal) or perpendicularly inclined. The columns 120 have sidewalls that are solid, but can be perforated. The columns 120 can include metal, metal alloy, plastic, polymer resin, or shape-memory alloy or resin. The columns 120 are unitary (e.g., molded, cast, additively manufactured) with the inner surface 104 or the wall 106 such that the columns 120 and the inner side 104 or the wall 106 include same material (e.g., plastic), but can be assembled with the inner side 104 or the wall 106 (e.g., fastened, mated, interlocked, adhered). The columns 120 include a plurality of notches 122 (or other male or female mating portions), whether unitary therewith (e.g., formed, molded, additively manufactured) or assembled therewith (e.g., mounted, fastened, mated, interlocked, adhered). For example, the columns 120 can include a plurality of spikes (e.g., conical) outwardly extending from the columns 120 away from the inner surface 104 or the wall 106, thereby forming a male mating portion. The notches 122 are distal to the inner surface 104 and can be proximal to the first slot 110, the second slot 112, the third slot 110, or the fourth slot 112.

Figure 2:
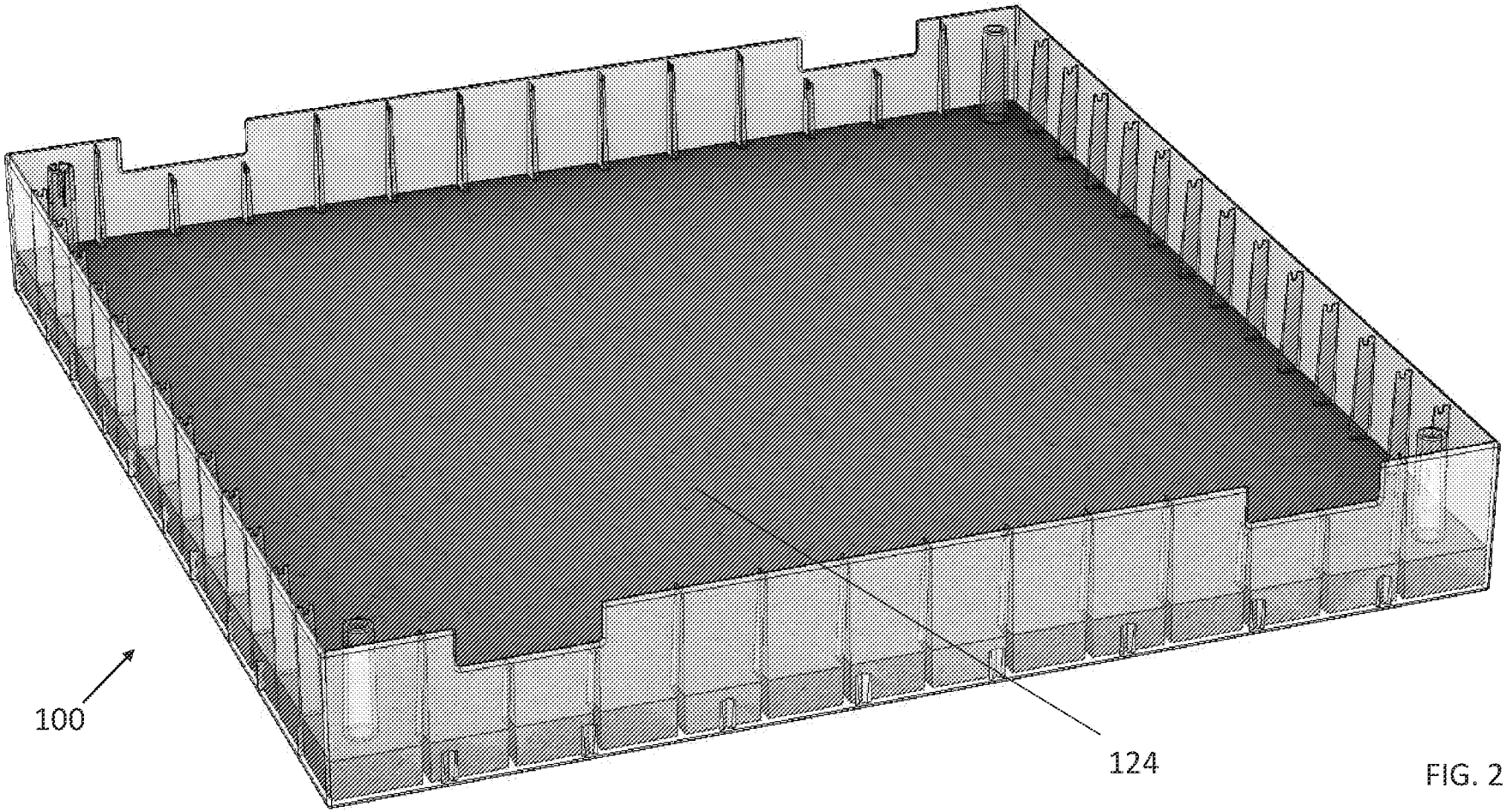
FIG. 2 shows an embodiment of a first unit being filled with a 100 pounds of a material in an uncured state according to this disclosure.
Figure 3:
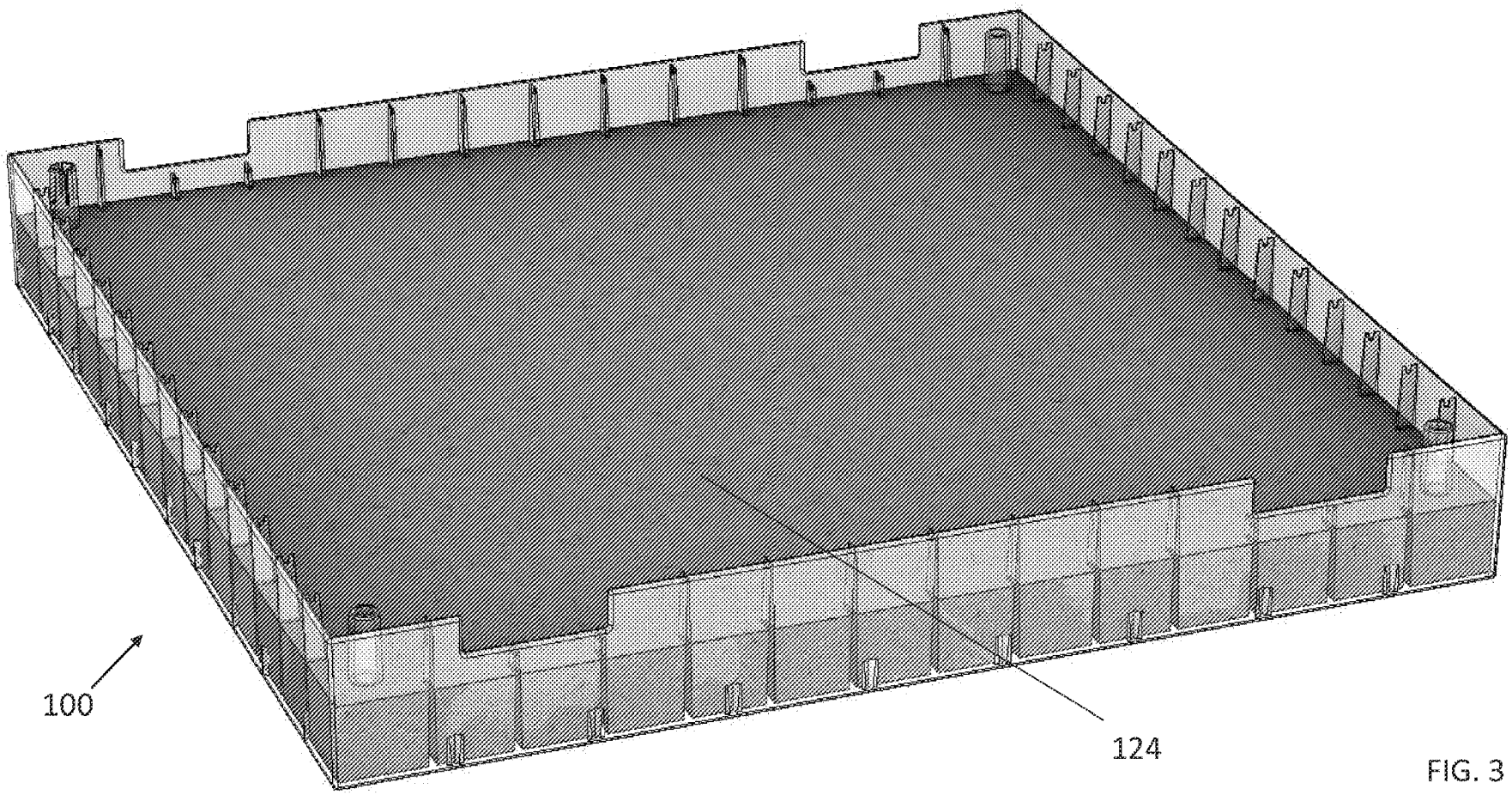
FIG. 3 shows an embodiment of a first unit being filled with a 200 pounds of a material in an uncured state according to this disclosure.

FIG. 2 shows an embodiment of a first unit being filled with a 100 pounds of a material in an uncured state according to this disclosure. FIG. 3 shows an embodiment of a first unit being filled with a 200 pounds of a material in an uncured state according to this disclosure. In particular, the first unit 100 is being filled (or otherwise input) with a volume of concrete 124, although other suitable materials are possible, whether these materials are capable or not capable of curing, whether hardening or solidifying thereby or not hardening or solidifying thereby. For example, the material can be configured to add weight (e.g., gel, foam, particulates, sand, beads). For example, the material can include a gelling formulation for subsequent mixing with water (e.g., at installation site) in order to harden the gel and add weight/bulk. For example, the gel can include a super absorbent polymer (SAP), such at least one of sodium polyacrylate, sodium polycarbonate, polyacrylamide copolymers, ethylene maleic anhydride, carboxymethylcellulose, polyvinyl alcohol copolymers, or polyethylene oxide, which may not expand upon freezing, thereby allowing the inner space of the first unit 102 to be filled with water. Note that although the material is shown with the 100 pounds or the 200 pounds, other amounts, whether higher (e.g., 220, 250, 300 pounds) or lower (e.g., 75, 50, 25 pounds) are possible, as needed. Further, note that although the volume of concrete 124 is formed before the first unit 100 is filled with the volume of the concrete 124, there are situations when the volume of concrete 124 can be formed within the first unit 100 (e.g., mixed) and then be left to cure within the first unit 100.

Figure 4:
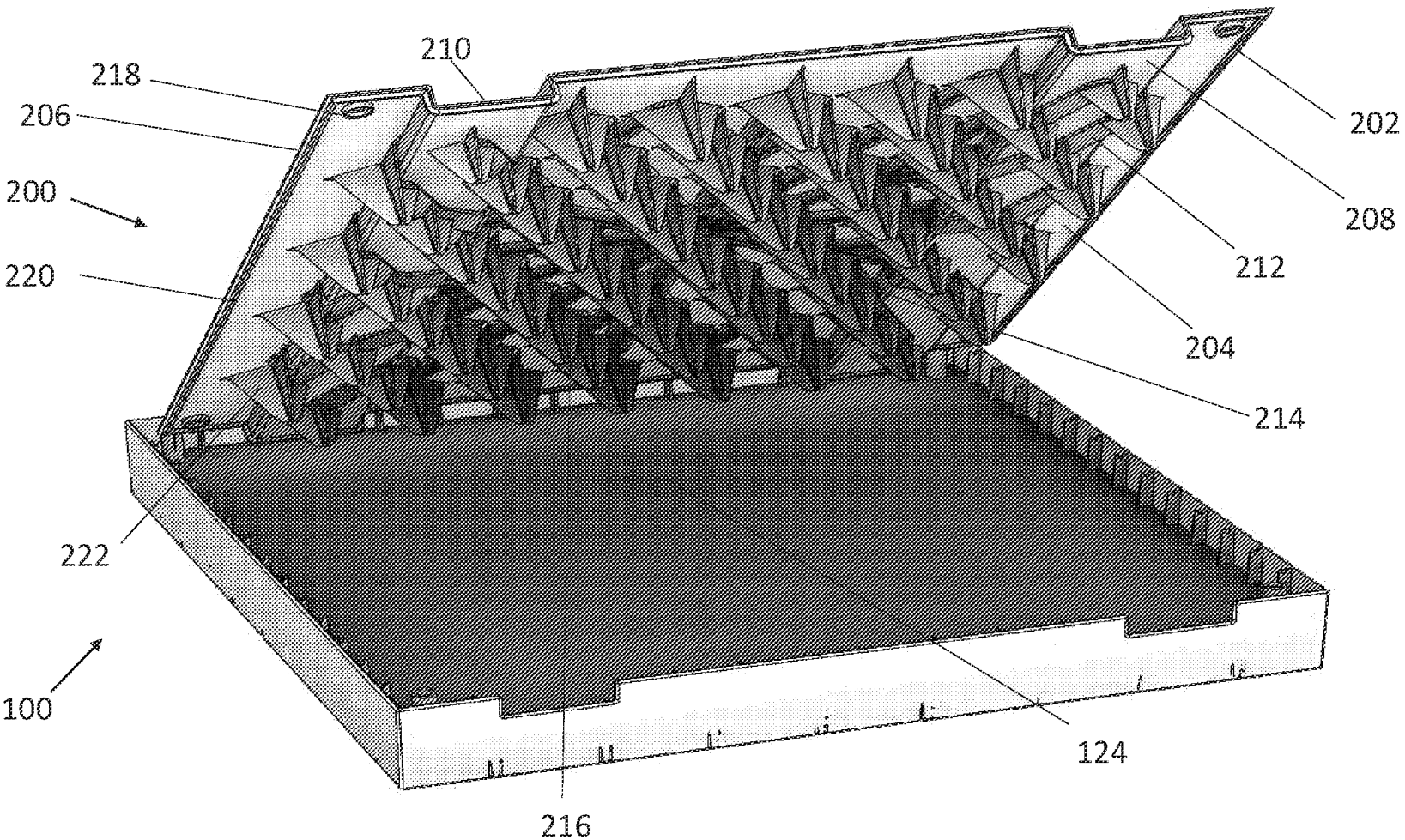
FIG. 4 shows an embodiment of a second unit being coupled to a first unit containing a material in an uncured state according to this disclosure.

FIG. 4 shows an embodiment of a second unit being coupled to a first unit containing a material in an uncured state according to this disclosure. In particular, a second unit 200 is a lid for the container of the first unit 100.

The second unit 200 includes a bottom side 202 including an inner surface 204 and an outer surface 206. The bottom side 202 including the inner surface 204 and the outer surface 206 can include metal, metal alloy, plastic, polymer resin, or shape-memory alloy or resin. The inner surface 204 and the outer surface 206 extend to define a plurality of channels (e.g., U-shape, V-shape) having a plurality of protrusions 208 and a plurality of depressions 210, with the protrusions 208 and the depressions 210 extending over each other, although the inner surface 204 can avoid forming the protrusions 208 when the bottom side 202 is sufficiently thick. As shown, the channels (208, 210) include a first channel and a second channel, where the first channel and the second channel extend parallel to each other, although non-parallel extension is possible, whether intersecting or not.

Although the first unit 100 and the second unit 200 are separate and distinct from each other, the second unit 200 can be pivotally or hingedly attached to the first unit 100. For example, the wall 106 can be hinged (e.g., butterfly hinge, living hinge, tether, strap, cable) to the bottom side 202.

The inner surface 204 or the bottom side 202 hosts (e.g., extends, supports, depends) a frame 212 including a center 214 and a plurality of elongated strips 216 radially extend from the center 214, in a sun-ray like manner, although a cellular, sieve, or mesh configuration (or another arrangement) is possible. The frame 212 including the center 214 and the elongated strips 216 can include metal, metal alloy, plastic, polymer resin, or shape-memory alloy or resin. The elongated strips 216 can be connected to each other (e.g., bridging portions spanning therebetween). For example, the elongated strips 216 can include a plurality of arms, whether of same or different length or shape or cross-section (or other characteristics or constituency) from the center 214. For example, the frame 212 can be assembled to the inner surface 204 or the bottom side 202 (e.g., snugly secured, pressure fit, fastened, mated, adhered, magnetized, interlocked) or the frame 212 can be unitary with the inner surface 204 or the bottom side 202 (e.g., molded, cast, additively manufactured) and include same material (e.g., plastic). For example, the inner surface 204 includes a first protrusion 208 and a second protrusion 208, where the first protrusion 208 opposes the first depression 210 and the second protrusion 208 opposes the second depression 210 and where the first protrusion 208 is parallel to the second protrusion 208 (although non-parallel extension is possible). As such, the frame 212 includes a first longitudinally elongated strip 216 and a second longitudinally elongated strip 216, where the first longitudinally elongated strip 216 extends over the first protrusion 208 and the second longitudinally elongated strip 216 extends over the second protrusion 208. Also, the first longitudinally elongated strip 216 extends past the first protrusion 208 and the second longitudinally elongated strip 216 extends past the second protrusion 208. As shown, such form of extension can enable securing of the elongated strips 216 to the inner surface 204.

The frame 212 including the center 214 or the elongated strips 216 include a plurality of spikes 222 extending therefrom away from the inner surface 204. The spikes 222 can include metal, metal alloy, plastic, polymer resin, or shape-memory alloy or resin. The spikes 222 can be rigid or flexible. Each of the spikes 222 is equilaterally three-sided (e.g., triangular), but this configuration can vary and at least some of the spikes 222 can have less than three sides (e.g., two) or more than three sides (e.g., four, five, six) or be non-equilaterally angled. Further, although each of the spikes 222 is symmetrical, at least some of the spikes 222 can be asymmetrical or some sides of some of the spikes 222 can vary from other sides of those spikes 222 (e.g., triangular and square). The spikes 222 are unitary (e.g., molded, cast, additively manufactured) with the frame 212 including the center 214 and the elongated strips 216 and include same material (e.g., plastic, metal), but can also be assembled with the frame 212 including the center 214 and the elongated strips 216 (e.g., fastening, mating, interlocking, magnetizing, adhering). Also, note that the frame 212 can be absent and the spikes 222 can extend from the inner surface 204, whether unitary therewith, as explained above, or assembled therewith, as explained above. For example, the bottom side 202 and the spikes 22 can be assembled with each other.

The bottom side 202 includes a plurality of bores 218 extending (e.g., spanning) between the inner surface 204 and the outer surface 206. The bores 218 are rectilinear, but can be non-rectilinear. The bores 218 are internally smooth, but can be internally threaded, whether male or female, whether clockwise or counterclockwise. The bores 218 are circular in cross-section, but can have a cross-section that is shaped differently (e.g., oval, triangular, square, rectangular, pentagonal). Note that the bottom side 202 can also avoid the bores 218.

The inner surface 204 includes a plurality of mating portions 220 peripherally extending therealong. The mating portions 220 can include metal, metal alloy, plastic, polymer resin, or shape-memory alloy or resin. The mating portions 220 extend away from the inner surface 204, thereby defining a male mating interface (e.g., projection). The mating portion 220 are shown are a single solid wall that peripherally extends away from the inner surface 204 about the frame 212 and the bores 218, although this form of extension can vary. For example, the mating portions 220 can include a plurality of walls spaced apart from each other, yet still peripherally extending away from the inner surface 204 about the frame 212 and the bores 218. Further, a portion of the frame 212 or at least one of the bores 218 can be not enclosed by the mating portion 220. Although the mating portions 220 are manifested as the single solid wall, the mating portions 220 can be manifested in other ways, whether male or female. For example, the mating portions 220 can include a plurality of wells inwardly extending from the inner surface 204 toward the outer surface 206, thereby defining a female mating interface (e.g., depression).

Figure 5:
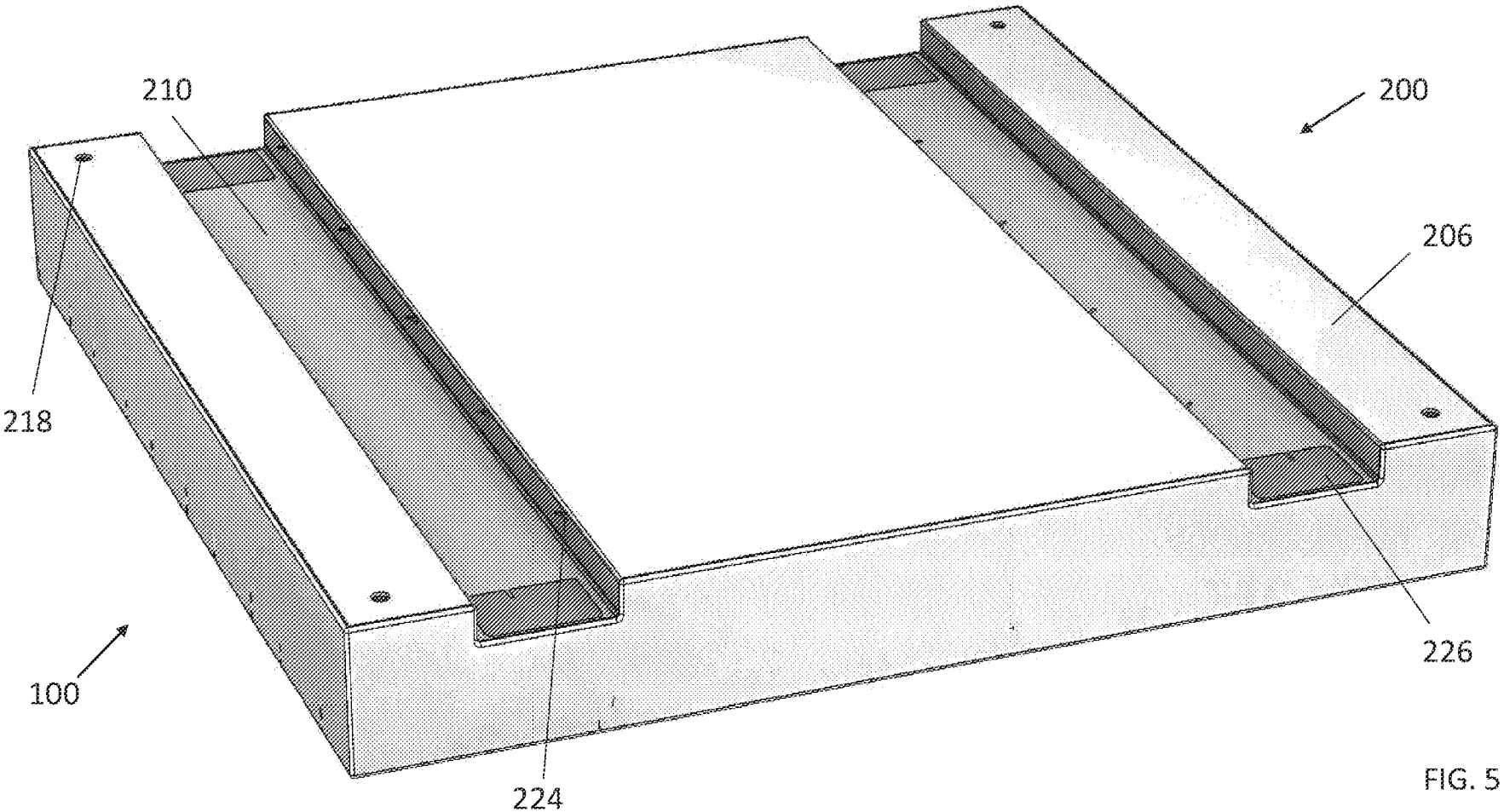
FIG. 5 shows a bottom view of an embodiment of a device for supporting an outdoor HVAC condenser unit according to this disclosure.
Figure 6:
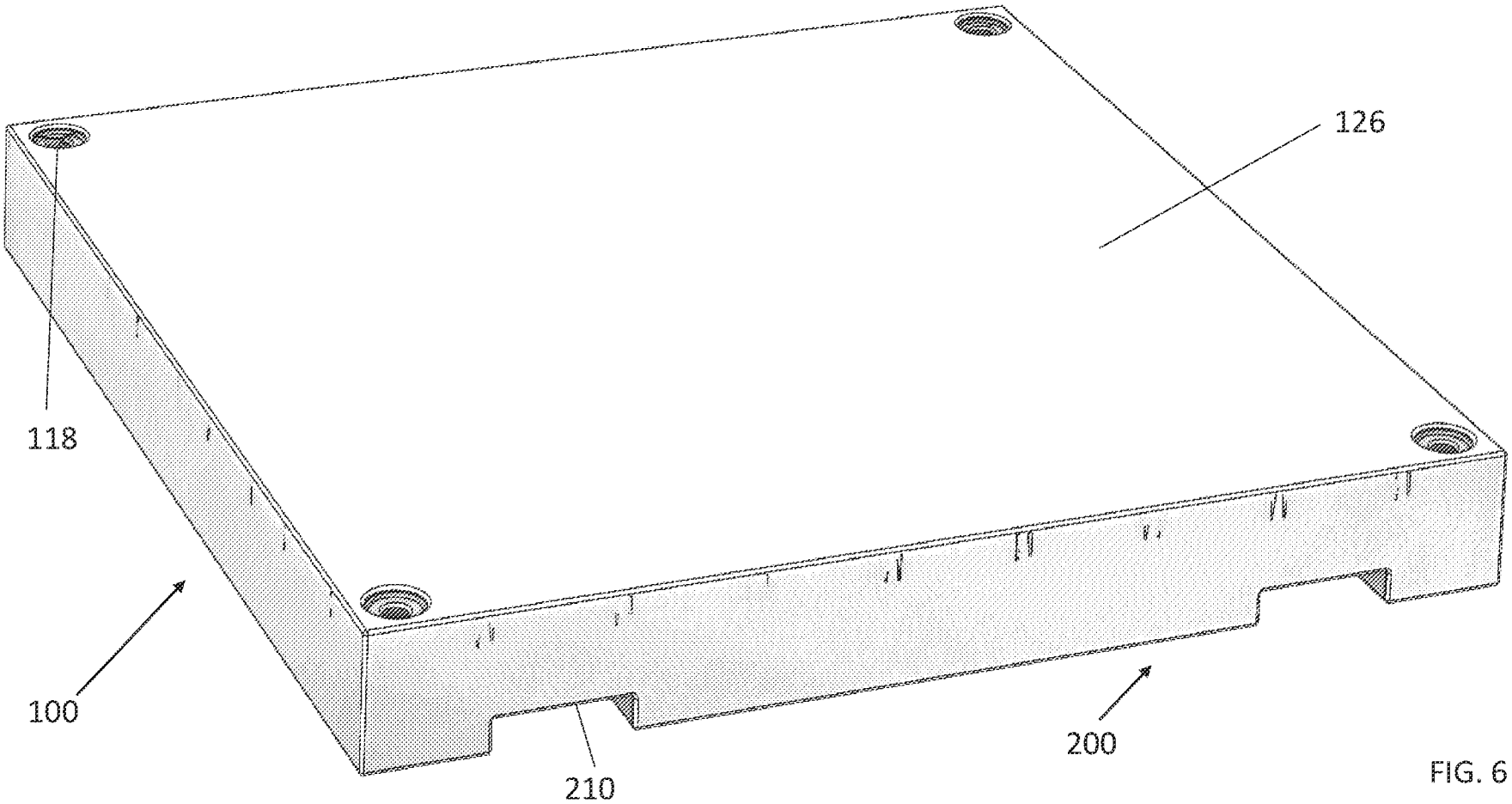
FIG. 6 shows a top view of an embodiment of a device for supporting an outdoor HVAC condenser unit according to this disclosure.

Based on above, as also shown in FIGS. 5 and 6, when the lid of the second unit 200 covers the container of the first unit 100, whether or not the volume of concrete 124 is contained within the container, various positioning occurs. For example, the spikes 222 can extend toward the inner surface 104 into the inner space as the inner surface 204 faces the inner surface 104 when the first channel (208, 210) is longitudinally co-aligned with the first slot 110 and the third slot 112 and the second channel (208, 210) is longitudinally co-aligned with the second slot 110 and the fourth slot 112. Further, the inner surface 204 can face the grid (114, 116) as the inner surface 204 faces the inner surface 104 when the first channel (208, 210) is co-aligned with the first slot 110 and the third slot 112 and the second channel (208, 210) is co-aligned with the second slot 110 and the fourth slot 112. Moreover, the spikes 222 can extend toward the cells 114 or the barriers 116 into the inner space as the inner surface 204 faces the inner surface 104 when the first channel (208, 210) is co-aligned with the first slot 110 and the third slot 112 and the second channel (208, 210) is co-aligned with the second slot 110 and the fourth slot 112. Additionally, the spikes 222 can contact or avoid contact with the inner surface 104 or the barrier 114 or the cells 116 as the inner surface 204 faces the inner surface 104 when the first channel (208, 210) is co-aligned with the first slot 110 and the third slot 112 and the second channel (208, 210) is co-aligned with the second slot 110 and the fourth slot 112. Furthermore, the spikes 222 can contact or can avoid contacting the wall 106 as the inner surface 204 faces the inner surface 104 when the first channel (208, 210) is co-aligned with the first slot 110 and the third slot 112 and the second channel (208, 210) is co-aligned with the second slot 110 and the fourth slot 112. In addition, the tubular members 118 and the bores 218 can be co-aligned with each other when the first channel (208, 210) is co-aligned with the first slot 110 and the third slot 112 and the second channel (208, 210) is co-aligned with the second slot 110 and the fourth slot 112. Moreover, the notches 122 (female) and the mating portions 220 (male) mate with each other (e.g., notch hosts protrusion) when the first channel (208, 210) is co-aligned with the first slot 110 and the third slot 112 and the second channel (208, 210) is co-aligned with the second slot 110 and the fourth slot 112. Note that such mating can be reversed.

FIG. 5 shows a bottom view of an embodiment of a device for supporting an outdoor HVAC condenser unit according to this disclosure. In particular, the lid of the second unit 200 covers the container of the first unit 100, with the volume of concrete 124, whether uncured, curing, or cured, being positioned within the inner space and contacting the spikes 222. As such, at least the first unit 100 and the second unit 200 together form a shell.

The outer surface 206 of the second unit 200 includes a plurality of projections 224 extending into the depressions 210 of the first channel and the second channel. The projections 224 can be unitary with the outer surface 206 or the bottom unit 202 (e.g., molded, cast, additively manufactured) and include same material (e.g., plastic, metal) or assembled with the outer surface 206 or the bottom unit 202 (e.g., fastened, mated, adhered). The projections 224 can include metal, metal alloy, plastic, polymer resin, or shape-memory alloy or resin.

The outer surface 206 of the second unit 200 includes a plurality of plates 226 extending within the depressions 210 of the first channel and the second channel, near a plurality of end portions thereof. The plates 226 are perpendicular, but can be shaped differently (e.g., square, circle, oval, trapezoid, pentagon, hexagon, open-shape). The plates 226 can include metal, metal alloy, plastic, polymer resin, or shape-memory alloy or resin. The plates 226 can be unitary with the depressions 210 or the outer surface 206 or the bottom unit 202 (e.g., molded, cast, additively manufactured) and include same material (e.g., plastic, metal) or assembled with the depressions 210 or the outer surface 206 or the bottom unit 202 (e.g., fastened, mated, adhered, magnetized, interlocked). As shown, the depressions 210 define a plurality of forklift slots for raising, lowering, or transporting the first unit 100 and the second unit 200, as a single unit, i.e., the shell.

Figure 7:
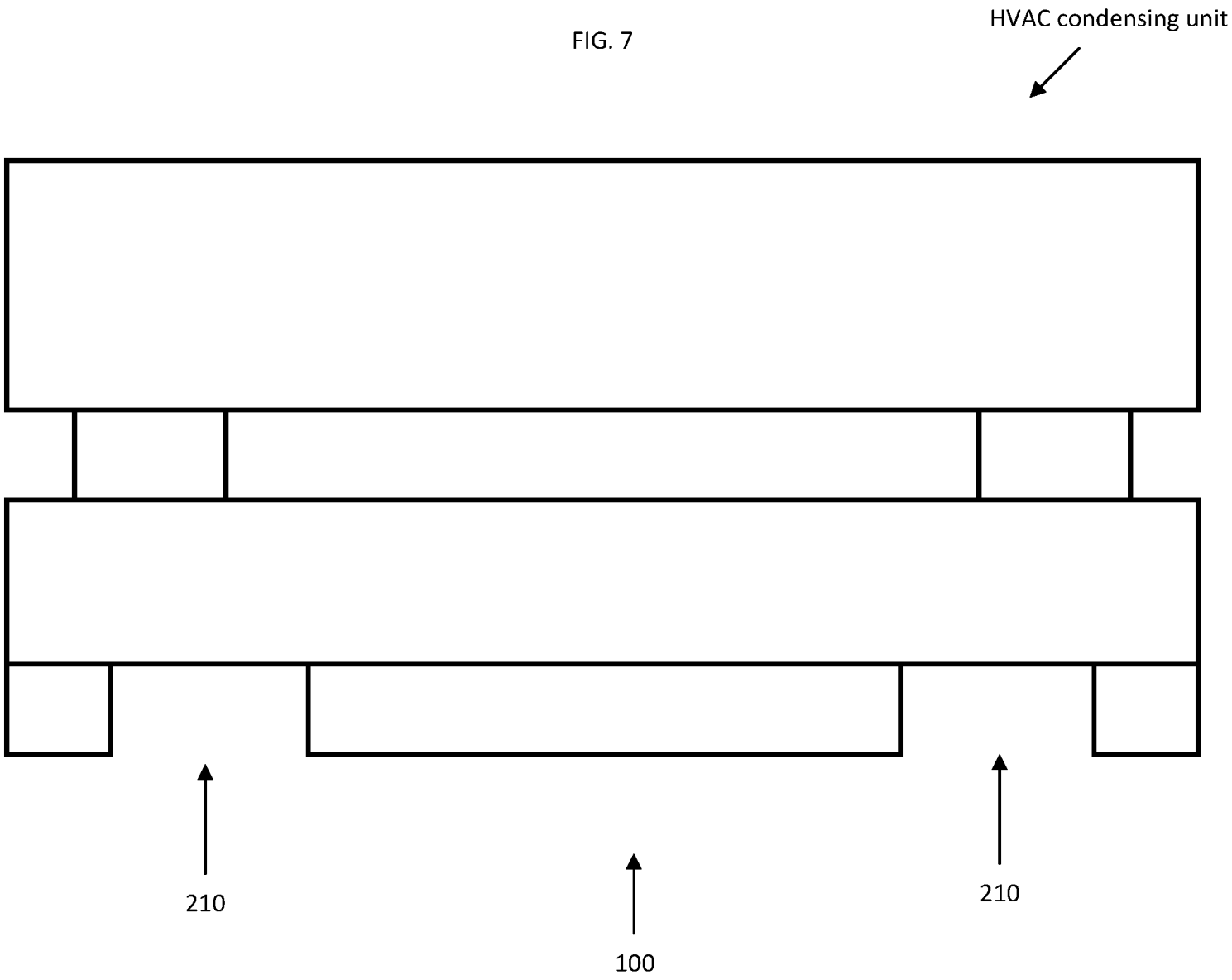
FIG. 7 shows a profile view of an embodiment of a device supporting an outdoor HVAC condenser unit according to this disclosure.
Figure 8:
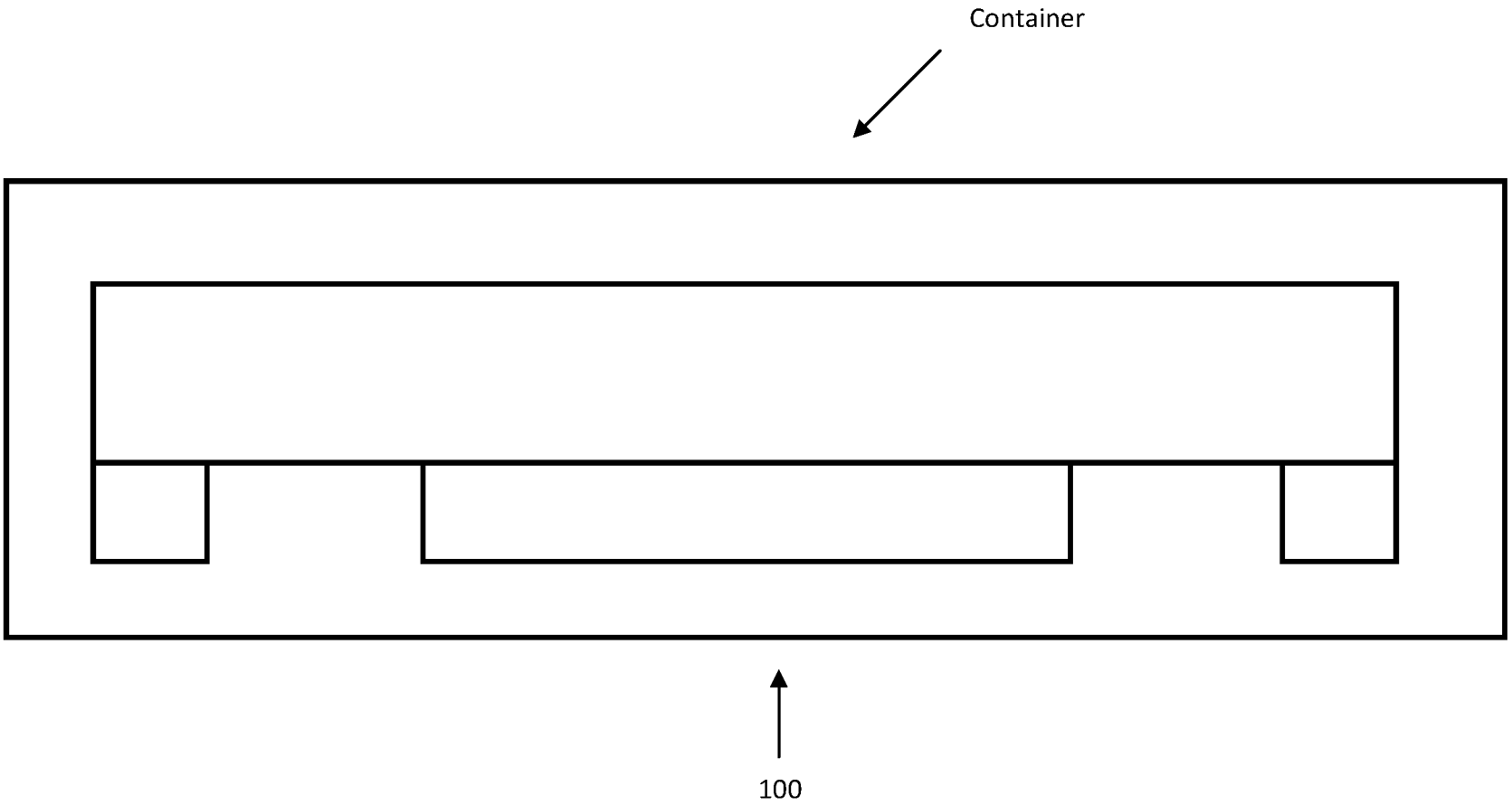
FIG. 8 shows a profile view of an embodiment of a container containing a device for supporting an outdoor HVAC condenser unit according to this disclosure.

FIG. 6 shows a top view of an embodiment of a device for supporting an outdoor HVAC condenser unit according to this disclosure, FIG. 7 shows a profile view of an embodiment of a device supporting an outdoor HVAC condenser unit according to this disclosure, and FIG. 8 shows a profile view of an embodiment of a container containing a device for supporting an outdoor HVAC condenser unit according to this disclosure. In particular, the top unit 100 has an outer surface 126 that is flat. Such configuration enables the outer surface 126 to support an outdoor HVAC condenser unit thereon, at least when the shell is formed. The outer surface 126 includes a plurality of openings leading to the tubular members 118, which are aligned with the bores 218. As such, the openings leading to the tubular members 118 allow a plurality of ground augers or anchors for additional overturn resistance, if needed. Note that the shell can be configured for outdoor use (e.g., weatherproof, stainless, rustproof, ultraviolet (UV) resistant, hurricane resistant, flooding resistant, corrosion resistant).

The first unit 100 and the second unit 200, alone or in combination, can be packaged in a container (e.g. paper or plastic envelope, corrugated shipping box, paper or plastic bag, sealed bag, storage container, cardboard box, transport package, consumer package, bubble wrap, foam blanket, garment blanket, can, shrink-wrap, molded pulp, blister pack, intermodal container). For example, the container can include a cuboid box, a shipping box, an intermodal container, or others. The container can include one or more devices, as disclosed herein or not disclosed herein. Note that container-within-container is possible. For example, the first unit 100 and the second unit 200, alone or in combination can be placed within a box, which may be placed within an intermodal container.

The outdoor HVAC condenser unit can be supported on the shell via the shell being secured to the ground via a plurality of augers or anchors though the tubular members 118. The top unit 100 including the outer surface 126 can contact the outdoor HVAC condenser unit. Further, the outdoor HVAC condenser unit can magnetically couple to the top unit 100 including the outer surface 126. As such, for example, when the shell is used to support the outdoor HVAC condenser unit in high velocity wind zones (e.g., Florida), the shell supporting the outdoor HVAC condenser unit can be hurricane resistant for winds of 200 miles per hour (mph) (or less or more) or exceed Miami-Dade 175 mph wind requirements (although non-exceeding is possible). However, note that the shell can be used in non high velocity wind zones (e.g., New Jersey, California).

Although the first unit 100 includes the container and the second unit 200 includes the lid, this configuration is reversible and a vice versa configuration is possible. For example, the first unit 100 include the lid and the second unit 200 can include the container, as disclosed herein.

Based on above, a method can include causing a volume of concrete 124 (or another material) in an uncured state to be input (e.g., poured) into the container of the first unit 100. The method can include causing the spikes 222 hosted via the lid of the second unit 200 to extend into the volume of the material in the uncured state within the container such that the lid closes the container and the lid faces the volume of concrete 124. The method can include causing the volume of concrete 124 within the container to change from the uncured state to a cured state within the container while the lid is closed such that the volume of concrete 124 in the cured state within the container secures the lid to the container via the spikes 222. The method can include causing the outdoor HVAC condenser unit to rest on the container such that the volume of concrete 124 in the cured state within the container extends between the outdoor HVAC condenser unit and the lid. When the lid includes a plurality of external forklift slots (depressions 210), then the method can include causing the container to be lifted via the external forklift slots while the volume of concrete 124 in the cured state within the container secures the lid to the container via the spikes 222, where the container is caused to be moved (e.g., raised, transported, lowered) via the external forklift slots before the outdoor HVAC condenser unit rests on the container. The method can include extending a plurality of ground anchors from the container through the lid while the volume of concrete 124 in the cured state within the container secures the lid to the container via the spikes 222. The anchors can extend from the container through the lid without contacting the volume of concrete 124. The method can include securing the outdoor HVAC condenser to the container while the outdoor HVAC condenser rests on the container (e.g., via L-shaped brackets).

Based on above, there can be a kit including the first unit 100, the second unit 200 and a container containing the first unit and the second unit.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. A device for supporting an HVAC condensing unit, the device comprising:

a top side including a first inner surface;

a wall hosted via the first inner surface such that the first inner surface and the wall form an inner space, wherein the wall includes a first side and a second side, wherein the first inner surface extends between the first side and the second side, wherein the first side includes a first slot dipping toward the first inner surface and a second slot dipping toward the first inner surface, wherein the second side includes a third slot dipping toward the first inner surface and a fourth slot dipping toward the first inner surface, wherein the first side opposes the second side such that the first slot opposes the third slot and the second slot opposes the fourth slot;

a bottom side including a second inner surface and an outer surface, wherein the outer surface includes a first channel and a second channel, wherein the first channel and the second channel extend parallel to each other; and a plurality of spikes hosted via the second inner surface, wherein the spikes extend toward the first inner surface into the inner space as the second inner surface faces the first inner surface when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side.

2. The device of claim 1, further comprising:

a grid hosted via the first inner surface, wherein the wall encloses the grid, wherein the second inner surface faces the grid as the second inner surface faces the first inner surface when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, (iii) the top side extends between the HVAC condensing unit and the bottom side, and (iv) the grid extends between the HVAC condensing unit and the second inner surface.

3. The device of claim 2, wherein the grid includes a plurality of barriers forming a plurality of cells, wherein the wall encloses the cells, wherein the second inner surface faces the barriers and the cells when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, (iii) the top side extends between the HVAC condensing unit and the bottom side, (iv) the grid extends between the HVAC condensing unit and the second inner surface, and (v) the barriers extends between the HVAC condensing unit and the second inner surface.

4. The device of claim 3, wherein the spikes extend toward the cells into the inner space as the second inner surface faces the first inner surface when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, (iii) the top side extends between the HVAC condensing unit and the bottom side, (iv) the grid extends between the HVAC condensing unit and the second inner surface, and (v) the barriers extends between the HVAC condensing unit and the second inner surface.

5. The device of claim 3, wherein the spikes extend toward the barriers into the inner space as the second inner surface faces the first inner surface when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, (iii) the top side extends between the HVAC condensing unit and the bottom side, (iv) the grid extends between the HVAC condensing unit and the second inner surface, and (v) the barriers extends between the HVAC condensing unit and the second inner surface.

6. The device of claim 3, wherein the cells are hexagonal.

7. The device of claim 3, wherein the cells are not hexagonal.

8. The device of claim 1, wherein the spikes avoid contact with the first inner surface as the second inner surface faces the first inner surface when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side.

9. The device of claim 1, wherein the spikes are configured to contact the first inner surface as the second inner surface faces the first inner surface when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side.

10. The device of claim 1, wherein the spikes extend from the second inner surface.

11. The device of claim 1, wherein each of the spikes is three-sided.

12. The device of claim 1, further comprising:

a frame secured to the second inner surface, wherein the spikes extend from the frame, wherein the frame extends between the HVAC condensing unit and the second inner surface when the HVAC condensing unit is supported via the top side.

13. The device of claim 12, wherein the frame includes a central portion and a plurality of longitudinally elongated strips, wherein the longitudinally elongated strips radially extend from the central portion, wherein the central portion or at least one of the longitudinally elongated strips extends between the HVAC condensing unit and the second inner surface when the HVAC condensing unit is supported via the top side.

14. The device of claim 12, wherein the second inner surface includes a first protrusion and a second protrusion, wherein the first protrusion opposes the first channel, wherein the second protrusion opposes the second channel, wherein the first protrusion is parallel to the second protrusion, wherein the frame includes a first longitudinally elongated strip and a second longitudinally elongated strip, wherein the first longitudinally elongated strip extends over the first protrusion, wherein the second longitudinally elongated strip extends over the second protrusion, wherein each of the first protrusion and the second protrusion protrudes towards the HVAC condensing unit when the HVAC condensing unit is supported via the top side.

15. The device of claim 14, wherein at least one of the first longitudinally elongated strip or the second longitudinally elongated strip respectively extends past at least one of the first protrusion or the second protrusion.

16. The device of claim 1, further comprising:

a plurality of tubular members hosted via the first inner surface, wherein the wall encloses the tubular members, wherein the bottom side includes a plurality of bores extending between second inner surface and the outer surface, wherein the tubular members and the bores are co-aligned with each other when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side.

17. The device of claim 1, further comprising:

a plurality of columns hosted via the first inner surface along the wall, wherein the wall encloses the columns.

18. The device of claim 17, wherein the columns include a first column and a second column, wherein the first column extends between the first inner surface and a slot selected from a group consisting of the first slot, the second slot, the third slot, and the fourth slot, wherein the second column does not extend between the first inner surface and the slot selected from the group consisting of the first slot, the second slot, the third slot, and the fourth slot, wherein the first column has a first height, wherein the second column has a second height, wherein the first height is less than the second height.

19. The device of claim 17, wherein the columns extend from the first inner surface.

20. The device of claim 1, further comprising:

a plurality of columns hosted via the wall, wherein the columns are exposed to the inner space.

21. The device of claim 20, wherein the columns include a first column and a second column, wherein the first column extends between the first inner surface and a slot selected from a group consisting of the first slot, the second slot, the third slot, and the fourth slot, wherein the second column does not extend between the first inner surface and the slot selected from the group consisting of the first slot, the second slot, the third slot, and the fourth slot, wherein the first column has a first height, wherein the second column has a second height, wherein the first height is less than the second height.

22. The device of claim 20, wherein the columns extend from the wall toward the inner space.

23. The device of claim 1, further comprising:

a plurality of columns hosted via at least one of the wall or the first inner surface along the wall, wherein the columns are exposed to the inner space, wherein the columns include a plurality of first mating portions positioned distal to the first inner surface; and a plurality of second mating portions peripherally hosted via the second inner surface, wherein the first mating portions and the second mating portions are configured to mate with each other when the first channel is co-aligned with the first slot and the third slot and the second channel is co-aligned with the second slot and the fourth slot.

24. The device of claim 23, wherein first mating portions include a female portion, wherein the second mating portions include a male portion, wherein the female portion mates with the male portion when the first channel is co-aligned with the first slot and the third slot and the second channel is co-aligned with the second slot and the fourth slot.

25. The device of claim 24, wherein the female portion is a notch, wherein the male portion is a protrusion, wherein the notch hosts the protrusion when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side.

26. The device of claim 23, wherein first mating portions include a male portion, wherein the second mating portions include a female portion, wherein the male portion mates with the female portion when the first channel is co-aligned with the first slot and the third slot and the second channel is co-aligned with the second slot and the fourth slot.

27. The device of claim 1, wherein the top side and the wall are unitary and include a same material.

28. The device of claim 1, wherein the bottom side and the spikes are assembled with each other.

29. The device of claim 1, wherein the outer surface is a first outer surface, wherein the top side includes a second outer surface, wherein the second outer surface is flat.

30. The device of claim 1, wherein the top side and the wall form a first unit, wherein the bottom side is included in a second unit that is hinged to the first unit.

31. A kit comprising:

a device configured for supporting an HVAC condensing unit, wherein the device includes a first unit and a second unit, wherein the first unit includes a top side and a wall, wherein the top side includes a first inner surface, wherein the wall is hosted via the first inner surface such that the first inner surface and the wall form an inner space, wherein the wall includes a first side and a second side, wherein the first inner surface extends between the first side and the second side, wherein the first side includes a first slot dipping toward the first inner surface and a second slot dipping toward the first inner surface, wherein the second side includes a third slot dipping toward the first inner surface and a fourth slot dipping toward the first inner surface, wherein the first side opposes the second side such that the first slot opposes the third slot and the second slot opposes the fourth slot;

wherein the second unit includes a bottom side and a plurality of spikes, wherein the bottom side includes a second inner surface and an outer surface, wherein the outer surface includes a first channel and a second channel, wherein the first channel and the second channel extend parallel to each other, wherein the spikes are hosted via the second inner surface, wherein the spikes extend toward the first inner surface into the inner space as the second inner surface faces the first inner surface when (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side; and a container containing the device.

32. A method comprising:

causing a user to access a device configured to support an HVAC condensing unit, wherein the device comprising:

a top side including a first inner surface;

a wall hosted via the first inner surface such that the first inner surface and the wall form an inner space, wherein the wall includes a first side and a second side, wherein the first inner surface extends between the first side and the second side, wherein the first side includes a first slot dipping toward the first inner surface and a second slot dipping toward the first inner surface, wherein the second side includes a third slot dipping toward the first inner surface and a fourth slot dipping toward the first inner surface, wherein the first side opposes the second side such that the first slot opposes the third slot and the second slot opposes the fourth slot;

a bottom side including a second inner surface and an outer surface, wherein the outer surface includes a first channel and a second channel, wherein the first channel and the second channel extend parallel to each other; and a plurality of spikes hosted via the second inner surface; and causing the user to operate the device such that the spikes extend toward the first inner surface into the inner space as the second inner surface faces the first inner surface and (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side.

33. The method of claim 32, wherein the device further comprising a grid hosted via the first inner surface, wherein the wall encloses the grid, wherein causing the user to operate the device is such that the second inner surface faces the grid as the second inner surface faces the first inner surface and (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, (iii) the top side extends between the HVAC condensing unit and the bottom side, and (iv) the grid extends between the HVAC condensing unit and the second inner surface.

34. The method of claim 32, wherein the spikes extend from the second inner surface.

35. The method of claim 32, wherein the device further comprising a frame secured to the second inner surface, wherein causing the user to operate the device is such that the spikes extend from the frame, wherein the frame extends between the HVAC condensing unit and the second inner surface when the HVAC condensing unit is supported via the top side.

36. The method of claim 32, wherein the device further comprising a plurality of tubular members hosted via the first inner surface, wherein the wall encloses the tubular members, wherein the bottom side includes a plurality of bores extending between second inner surface and the outer surface, wherein causing the user to operate the device is such that the tubular members and the bores are co-aligned with each other and (a) the first channel is co-aligned with the first slot and the third slot, (b) the second channel is co-aligned with the second slot and the fourth slot and (c) the HVAC condensing unit is supported via the top side such that (i) the inner space extends between the HVAC condensing unit and the second inner surface, (ii) the spikes extend between the HVAC condensing unit and the second inner surface, and (iii) the top side extends between the HVAC condensing unit and the bottom side.

37. The method of claim 32, wherein the device further comprising (1) a plurality of columns hosted via at least one of the wall or the first inner surface along the wall and (2) a plurality of second mating portions peripherally hosted via the second inner surface, wherein the columns are exposed to the inner space, wherein the columns include a plurality of first mating portions positioned distal to the first inner surface, wherein causing the user to operate the device is such that the first mating portions and the second mating portions mate with each other and the first channel is co-aligned with the first slot and the third slot and the second channel is co-aligned with the second slot and the fourth slot.

38. The method of claim 32, wherein the bottom side and the spikes are assembled with each other.

* * * * *